US008631777B2

(12) United States Patent
Brown et al.

(10) Patent No.: US 8,631,777 B2
(45) Date of Patent: Jan. 21, 2014

(54) RIGID PRIMER BULB PUMP

(75) Inventors: Christopher Brown, Merritt Island, FL (US); Marvin Peplow, Bartlett, IL (US)

(73) Assignee: Bluskies International LLC, Bartlett, IL (US)

( * ) Notice: Subject to any disclaimer, the term of this patent is extended or adjusted under 35 U.S.C. 154(b) by 731 days.

(21) Appl. No.: 12/904,319

(22) Filed: Oct. 14, 2010

(65) Prior Publication Data

US 2011/0088648 A1 Apr. 21, 2011

Related U.S. Application Data

(63) Continuation-in-part of application No. 12/313,268, filed on Nov. 18, 2008, now Pat. No. 8,069,830.

(60) Provisional application No. 61/065,175, filed on Feb. 8, 2008.

(51) Int. Cl.
*F02M 1/16* (2006.01)
*F04B 23/08* (2006.01)

(52) U.S. Cl.
USPC ..... 123/179.11; 417/199.2

(58) Field of Classification Search
USPC ..... 123/179.11; 417/199.1, 199.2
See application file for complete search history.

(56) References Cited

U.S. PATENT DOCUMENTS

| | | | | |
|---|---|---|---|---|
| 1,829,050 | A * | 10/1931 | McClure | 123/179.11 |
| 3,565,555 | A * | 2/1971 | Akashi et al. | 417/568 |
| 3,803,988 | A * | 4/1974 | Orr | 92/85 R |
| 3,881,839 | A | 5/1975 | MacManus | 415/55.4 |
| 3,948,589 | A * | 4/1976 | DuBois | 417/487 |
| 3,983,857 | A | 10/1976 | O'Connor | 123/179.11 |
| 4,012,174 | A * | 3/1977 | Seibel et al. | 417/307 |
| 5,516,266 | A | 5/1996 | Talaski | 417/540 |
| 5,655,892 | A | 8/1997 | Cherniawski et al. | 417/292 |
| 5,664,532 | A * | 9/1997 | August | 123/179.11 |
| 7,556,025 | B2 | 7/2009 | Sotiriades | 123/516 |
| 2004/0033143 | A1 | 2/2004 | Proust | 417/199.1 |
| 2004/0079752 | A1 | 4/2004 | Suzuki et al. | 220/4.13 |
| 2004/0178519 | A1 | 9/2004 | Krilin et al. | |
| 2006/0115370 | A1 | 6/2006 | Milton | 417/572 |
| 2007/0128054 | A1 | 6/2007 | Wrench et al. | 417/413.1 |
| 2007/0144604 | A1 | 6/2007 | Michael | 141/59 |

FOREIGN PATENT DOCUMENTS

| | | |
|---|---|---|
| EP | 1925811 A1 | 5/2008 |
| GB | 2114237 A1 | 8/1983 |

OTHER PUBLICATIONS

International Search Report and Written Opinion of International Searching Authority, Sep. 30, 2010 for PCT/US2009/064667 (related to current case).

* cited by examiner

*Primary Examiner* — Stephen K Cronin
*Assistant Examiner* — Sizo Vilakazi
(74) *Attorney, Agent, or Firm* — Clifford Kraft

(57) ABSTRACT

A hand operated primer pump for small marine or other engines generally spark ignition engines used on stern drive boats that prevents transfer of hydrocarbons into the atmosphere. The primer generally mimics and replaces prior art rubber primer bulbs in general shape and possibly color, although it can be made in any shape or color. It generally contains a pump that delivers a precise measured amount of fuel with each stroke of the actuator. The primer can have an ergonomically designed actuator that creates the farthest distance from a fulcrum point for maximum leverage and hence, maximum ease of use. The primer is generally designed with a continuous molded fuel path to seal any source of hydrocarbon leakage as well as being made from materials that prevent transfer of hydrocarbons to the atmosphere.

17 Claims, 9 Drawing Sheets

RIGID PRIMER BULB PUMP

This application is a continuation-in-part of co-pending application Ser. No. 12/313,268 filed Nov. 18, 2008 which was related to and claimed priority from U.S. Provisional patent application No. 61/065,175 filed Feb. 8, 2008. Application Ser. Nos. 12/313,268 and 61/065,175 is hereby incorporated by reference.

BACKGROUND

1. Field of the Invention

The present invention relates to primers for marine engines and more particularly to a rigid primer bulb pump that does not emit any hydrocarbons.

2. Description of the Prior Art

Outboard mounted spark ignition marine engines used on stern drive boats currently employ a semi-rigid rubber primer bulb type pumping device to provide initial prime to the fuel supply system. These devices are simply rubber bulbs mounted on fuel hoses usually equipped with a set of one-way valves to direct the direction of pumping when the bulb is squeezed.

This type of prior art device, by nature of its makeup and material, is generally permeable. Because of that, it releases a small percentage of the hydrocarbons that pass through it into the atmosphere. It is very undesirable to pass any fuel hydrocarbons into the atmosphere since that represents a source of pollution and may violate future government regulations. It would be advantageous to have a primer for outboard mounted engines that was made from a rigid polymer and avoided this shortcoming by not allowing leakage or permeation of hydrocarbons into the atmosphere.

SUMMARY OF THE INVENTION

The present invention relates to a hand operated primer pump for small marine or other engines generally spark ignition engines used on stern drive boats that prevents transfer of hydrocarbons into the atmosphere. The primer of the present invention generally mimics and replaces prior art rubber primer bulbs in general shape and possibly color, although it can be made in any shape or color. It is generally made from rigid or semi-rigid polymer material. The primer of the present invention contains a pump that delivers a precise measured amount of fuel with each stroke of the actuator. The present invention can have an ergonomically designed actuator that creates the farthest distance from a fulcrum point for maximum leverage and hence, maximum ease of use. The primer of the present invention is designed to tightly fit together to seal any source of hydrocarbon leakage and generally to use a continuously molded fuel path as well as being made from materials that prevent transfer of hydrocarbons to the atmosphere.

DESCRIPTION OF THE FIGURES

Attention is directed to several illustrations that aid in understanding the present invention.

Several drawings and illustrations have been provided to help understand the invention. The scope of the present invention is not limited to what is shown in this figures.

DESCRIPTION OF THE INVENTION

Figure 1:
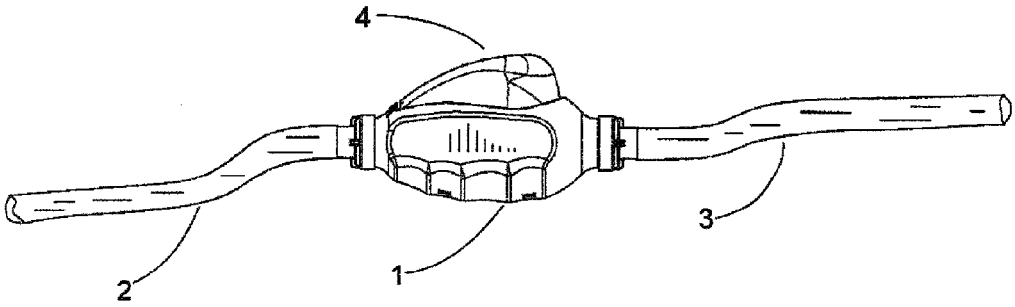
FIG. 1 shows a side view of an embodiment of the present invention.

The priming system of the present invention uses a hand squeeze or thumb press operation to pump fuel in one direction through the device by means of a piston pump 1 shown in FIG. 1. A supply hose 2 runs to a fuel tank to supply fuel to the system. An exit hose 3 runs to the engine. A hand or thumb squeeze actuator 4 is mounted on the top of the pump 1 and delivers a precisely measured amount of fuel to the engine when it is squeezed. While the pump is in the relaxed position, the engine can draw fuel through it from the tank in normal operation.

Figure 2A:
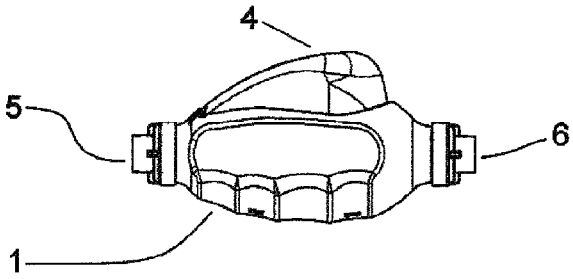
FIGS. 2A-2C show a side view, top view and rear end view of the embodiment of FIG. 1.
Figure 2B:
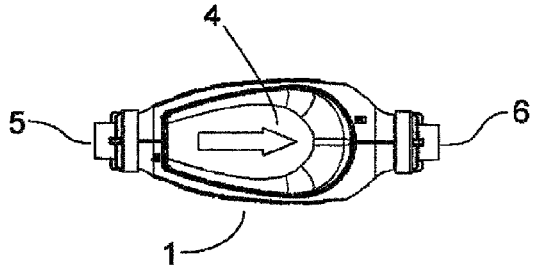
Figure 2C:
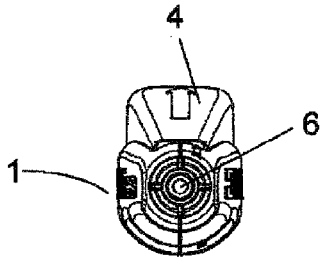

FIGS. 2A-2C show a side view, top view and rear end view of the embodiment of FIG. 1. A rear entrance orifice 5 and a front exit orifice 6 can be seen. Fuel hoses generally attach to these orifices. The actuator 4 is generally located at the top of the device and can be captured at a lower extremity on each side at two pivot points. The pivot points on the actuator 4 can be holes that correspond to a pair of protrusions molded onto the top of the lower fuel path section of the pump body 1. The actuator 4 can sit directly on top of a cup shaped piston guide, which in turn fits onto the outside surface of the generally cylindrical piston housing protruding extremity at the top of the pump body. The piston is either directly or indirectly affixed to a seal which is positioned inside the pump body cylinder bore facing downward towards the fuel path in the lower section of the pump body. A spring placed under tension between the piston assembly and a corresponding cylindrical cup shaped recess that can be molded in the lower extremity of the pump body.

Figure 3:
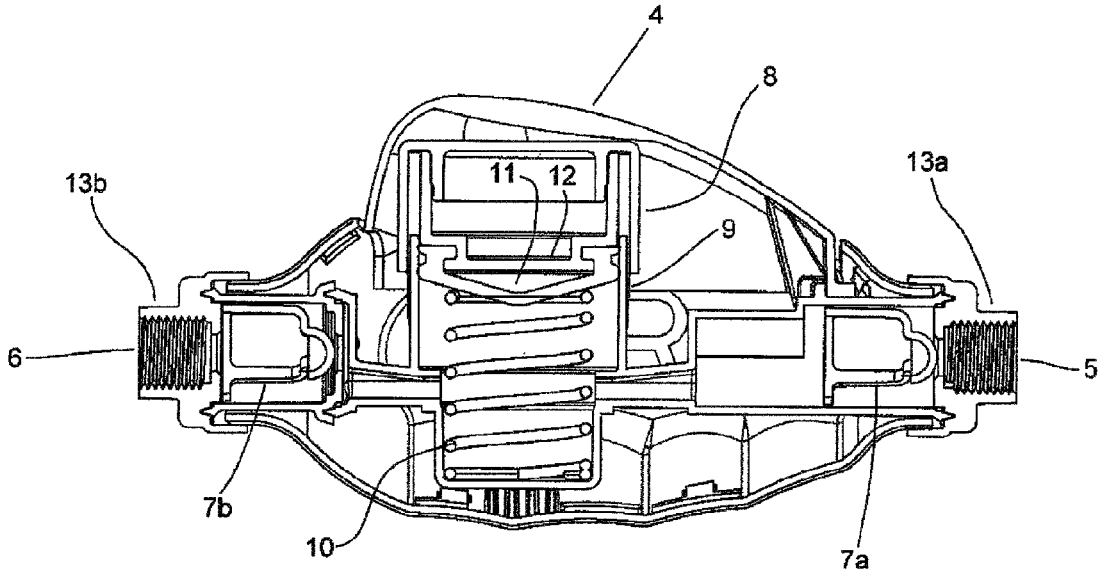
FIG. 3 shows a side sectional view of an embodiment of the present invention.
Figure 4:
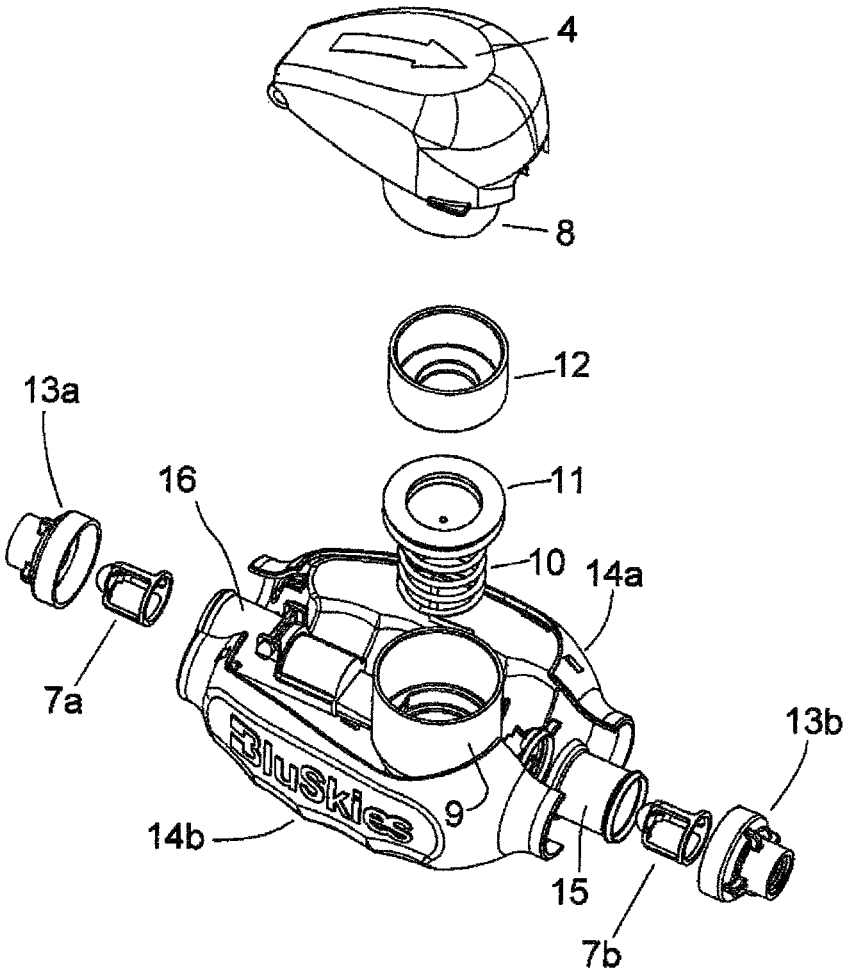
FIG. 4 shows an exploded view of the embodiment of FIG. 3.

FIG. 3 and FIG. 4 show a side sectional view and an exploded view of an embodiment of the pump mechanism of the present invention. Fuel enters the entrance orifice 5 in a molded entry fitting 13*a* where it encounters a entry check plunger 7*a*. A continuous channel connects the rear part of the pump to the front part allowing fuel to pass through the pump chamber 9 when the pump is in the relaxed position (as shown in FIG. 3). At the front of the pump, fuel can flow out through an exit check plunger 7*b* into an exit orifice 6 in a molded exit fitting 13*b*. The rear and front check plungers 7*a*, 7*b* act as one-way valves that prevent any reverse fuel flow during pumping. The check plungers 7*a*, 7*b* are facing in the same direction with a dome towards the direction from which the fuel will enter the pump body. The molded fittings 13*a* and 13*b* have a molded valve seat that corresponds to the domed end of the check plunger 7*a* or 7*b*.

The pump priming system of the present invention is designed primarily for a human hand to squeeze; however, it can be depressed by thumb, foot or other body extremity to cause the actuator 4 to depress by lever action around a fulcrum point and cause a piston guide 8 and piston assembly to displace the internal volume of mass in the pump cylinder bore.

The pump actuator 4 pushes a piston 12 downward against a spring 10 when squeezed by means of a piston guide 8 attached to the actuator. The piston 12 pushes a seal 11 down into the pump chamber 9 causing the amount of fuel in the pump chamber to be forced out of the exit orifice 6 through the exit check plunger 7*b*. The volume of fuel in the bore travels into the fuel path underneath the cylinder. When the pump actuator 4 is released, the spring 10 causes the piston 8 and seal 11 to return to their relaxed position as shown in FIG. 3. However, as the piston and seal return upward, they draw a quantity of fuel in from the entrance orifice 5 through the entrance check plunger 7*a*. As previously stated, the entrance and exit check plungers 7*a*, 7*b* act as one-way valves allowing the pumping action to take place and not permitting any fuel flow in the opposite direction.

FIG. 4 also shows a possible construction of the pump using a pump central body 16, a left side housing 14*a*, a right side housing 14*b* and a molded check seat 15 to receive the exit check plunger 7*b*. The molded fittings 13*a* and 13*b* can optionally be identical for ease in manufacture. The left and right side housings 14*a*, 14*b* each can form a half-shell the fit together around the pump central body 16 and check plungers 71, 7*b*.

Figure 5:
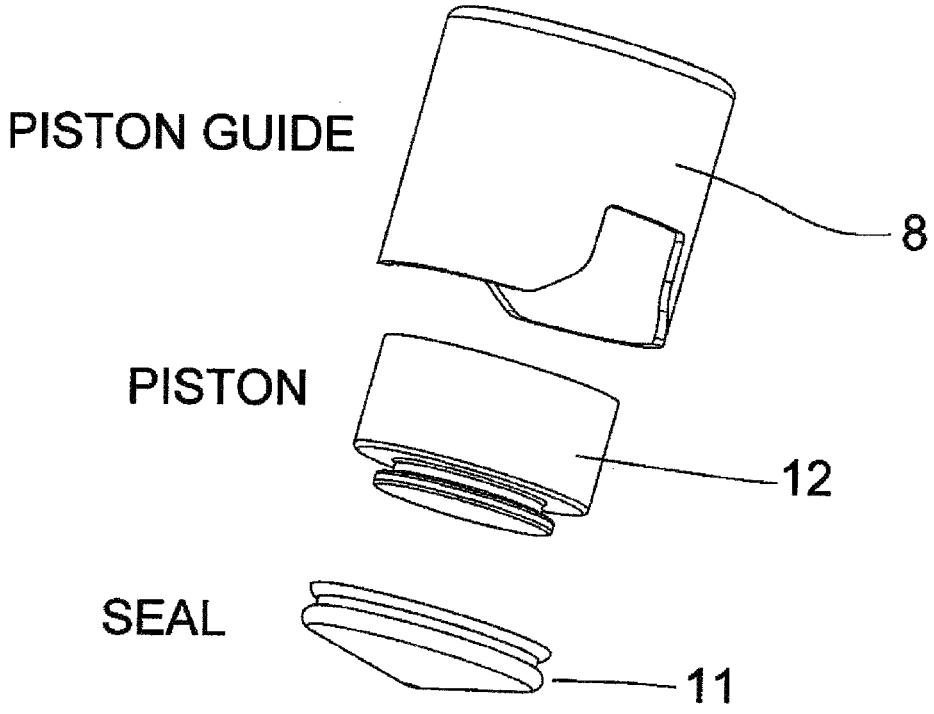
FIG. 5 shows an exploded side view of the piston guide, piston and seal from FIG. 4.

FIG. 5 shows a side exploded view of the relationship between the piston guide 8, the piston 12 and the seal 11.

As previously stated, the primer pump of the present invention can mimic current rubber primer bulbs in shape and color, although it can be made rectangular, tubular or any other shape and can be designed to be attached to a fuel tank, a marine engine or be mounted in-line with the fuel hose. The preferred material for the body of the present invention is polybutylene terephthalate (PBT), polycarbonate, polycarbonate PBT (PC/PBT) Nylon 6, acetal (acetyl), polyethylene's with nano-sized platelets that act as a hydrocarbon barrier or any rigid polymer material that meets federal low permeation standards of less than 15 g/sq. m./day. A preferred material is a polymer with an embedded layer of carbon or other platelet particles that prevent hydrocarbon transfer. Acetal is also a preferred material. The material used must generally be capable of being molded into components for assembly. It is essential that the molded components to either have no seams or to fit together in such a way that there is no leakage or transfer of hydrocarbons at any seams.

U.S. Government rules for marine fuel system hydrocarbon emissions are 0.4 g/gallon/day for diumal venting from a fuel tank at 35.6 degrees C.; 1.5 g/gallon/day permeation from a fuel tank at 40 degrees C.; and 15/g/sq. meter/day for hose and primer bulb permeation at 23 degrees C. (15 g/sq. meter/day with 15% methanol blend fuel). A test fuel of 10% ethonol and 90% indolene can be used for normal testing. The final primer assembly should meet these requirements. Acetal generally has a permeation of around 1.2 g/sq. meter/day, so for a fuel path with a surface area of around 10.6 sq. inches (0.00684 sq. m) for example, the total emission for the pump would be around 0.0082 g/day.

The primer spring can be made from stainless steel or from a polymer with the ability to compress and expand sufficiently to provide sufficient force. The seal can be made from a low permeation elastomer such as VITRON™ manufactured by DuPont Dow.

The primer pump of the present invention is made from several molded parts as has been described. These parts are together into a finished unit so that the final product meets permeation requirements. In particular, in a preferred embodiment, the fuel path is a continuous molded unit from the entry hose to the exit hose. The only opening is around the pump seal 11 and, of course, where the fuel lines terminate. The pump seal can be made from a low permeation elastomer as previously explained to keep hydrocarbon emission within limits.

While the primer of the present invention is intended primarily for fuels, it can also be used in any type of suction application such as the suction and delivery of any oils or other fluids needing priming, and particularly in the suction and delivery of any fluid needed to prime a fluid circuit, or pump fluid from a reservoir to another place.

Figure 6A:
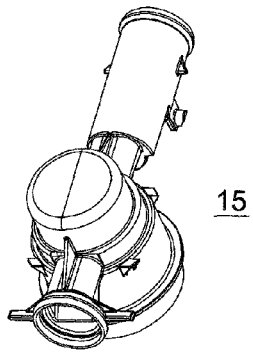
FIGS. 6A-6C show a different embodiment of a pump body.
Figure 6B:
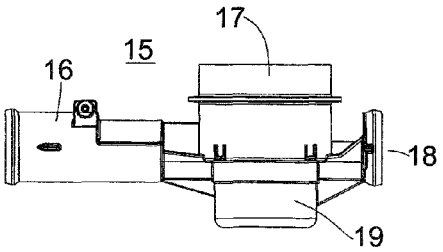
Figure 6C:
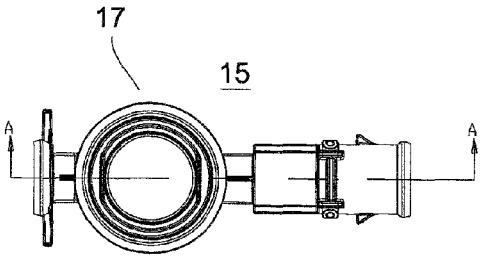

FIGS. 6A-6C show an alternate embodiment of a pump body 15. FIG. 6A is a perspective view, FIG. 6B a side view, and FIG. 6C a top view. The body 15 contains a fuel chamber 17 with base part 19 with fuel inlet and outlet 16, 18.

Figure 7A:
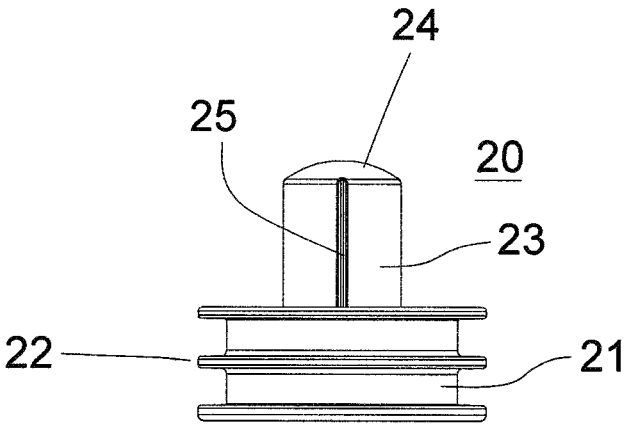
FIGS. 7A-7B show a different embodiment of a piston.
Figure 7B:
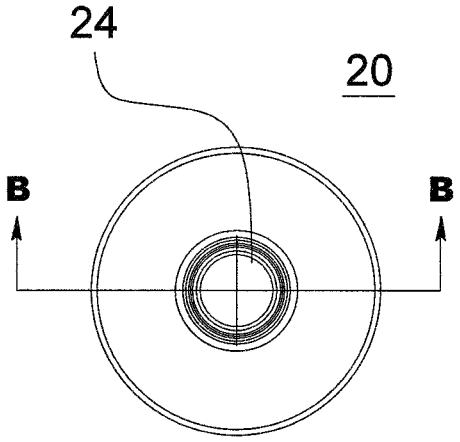

FIGS. 7A-7B show an alternate embodiment of a piston 20. FIG. 7A is a side view; FIG. 7B is a top view. The piston 20 includes a base part 22, elongated part 23 and rounded top 24. The base part 22 contains a ridge that separates two grooves 21 designed to receive two separate fuel seals. In the event an operator of the device continues to apply priming strokes in an effort to deliver fuel to the engine, even when the engine is fully primed, a floating valve seat 36 (in FIG. 8) lifts when back pressure exceeds around 5-8 psig allowing relief back into the fuel tank. Additionally, the piston rod 20 is grooved 25 (FIG. 7A) to allow air passage to replace and evacuate the displaced air volume on the airside of the piston bore.

Figure 8:
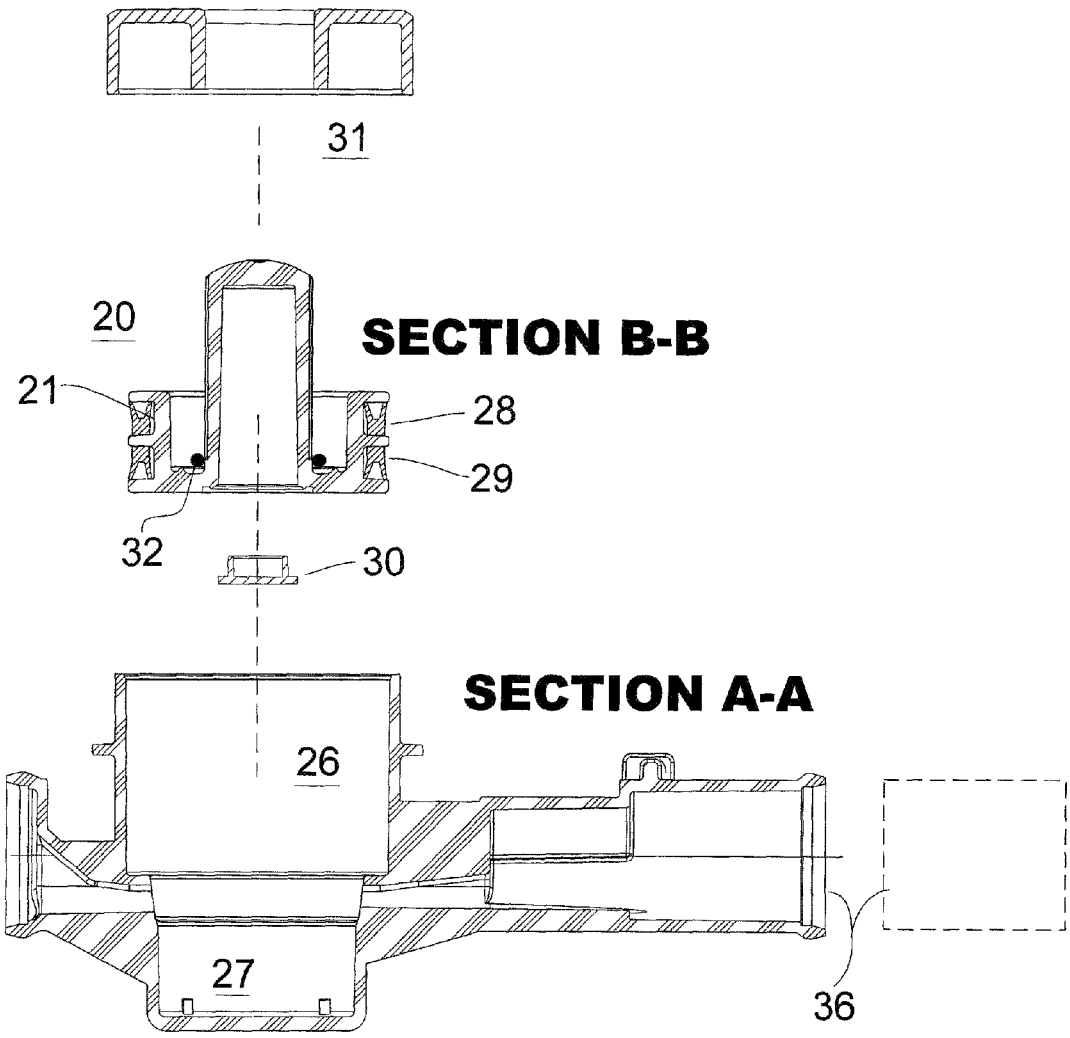
FIG. 8 shows a sectional view of the body of FIGS. 6A-6C, piston of FIGS. 7A-7B in an exploded arrangement.

FIG. 8 shows a sectional view of the body 15 from FIG. 6, the piston 20 from FIG. 7 and a piston cover 31. The view in FIG. 8 is exploded. The piston 20 pushes down on spring (not shown) and a piston plug 30 in the fuel chamber 26. A piston cover 31 fits over top of the fuel chamber 26 and allows the piston 20 to move downward through it.

The piston 20 holds two piston seals 28 and 29 that are mounted in the grooves 21 on the piston. The seal functions have been separated into three specific categories. The first seal 29 is a primary fuel seal. It is a generally u-cupped design with the cupping feature facing the fuel. This first primary seal 29 facilitates the pumping action as it energizes under pressure during the down-stroke. The second seal 28 is a generally u-cupped design with the cupping feature facing the air/atmosphere. This second seal 28 eliminates the propensity for air to be drawn into the fuel cylinder during the piston up-stroke. Additionally, this second seal 28 acts as secondary fuel sealing in its at-rest or static top dead center position. The third seal is an O-ring 32 nested at the lowest point on the piston rod diameter. This seal is forced against the underside of the fuel path cap bushing by the return spring located underneath which is in constant contact with the piston face on the fuel side of the fuel path. This final seal 32 is for redundancy and provides sealing in case of a catastrophic failure of the first and secondary u-cup seals.

An optional, over-pressure relief mechanism 36 can be located anywhere in the intake pathway of the device, or on an external hose interface piece (a barbed hose fitting for example). In the event an operator of the fuel primer continues to apply priming strokes in an effort to deliver fuel to the engine, even when the engine is fully primed, a floating valve seat can lift when back pressure exceeds a predetermined amount such as 5-8 psig. This facilitates relief pressure back into the fuel tank. This over-pressure mechanism 36 can be biased with a spring.

The seals should be made from a blend of acrylic and nitrile polymers containing from around 1% to around 90% acrylic to provide sufficient chemical resistance to ethanol enhanced fuel blends while simultaneously allowing the nitrile to retain sufficient energy to enable the sealing interface at the lip of the u-cup profile to remain sealed at or below zero degrees Fahrenheit. Additionally, it is preferred to coat the seals with polytetrafluoroethylene. This enables ease of assembly, dry priming and extended expected component useful life of two or more years.

To minimize the propensity of the piston seals to be pushed out of alignment by the operator, the piston and piston rod component, in addition to holding the fuel primer seals, is directly pushed up and down by the use of an actuator by the operator. The piston rod should generally be sized to have minimal clearance through a corresponding guide bushing in the fuel path cap thus minimizing any rocking action that could potentially allow the seal to be forced off the cylinder wall.

To minimize hydrocarbon migration, and to facilitate accurate alignment of the piston during operation, the fuel path cap or cover 31 can be spun welded to the top of the fuel path cylinder bore. This cap 31 generally contains a bushing that is designed to allow the piston rod to pass through freely with minimal clearance in its up and down travel. This minimizes any rocking motion.

Figure 9B:
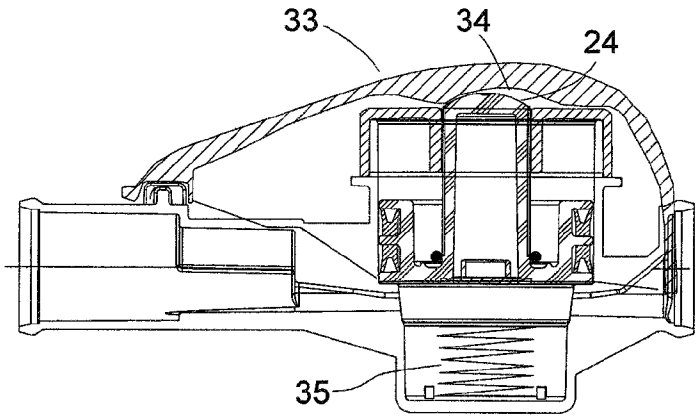
FIGS. 9A-9B show the curved-arc functioning of the push cover and the piston.
Figure 9A:
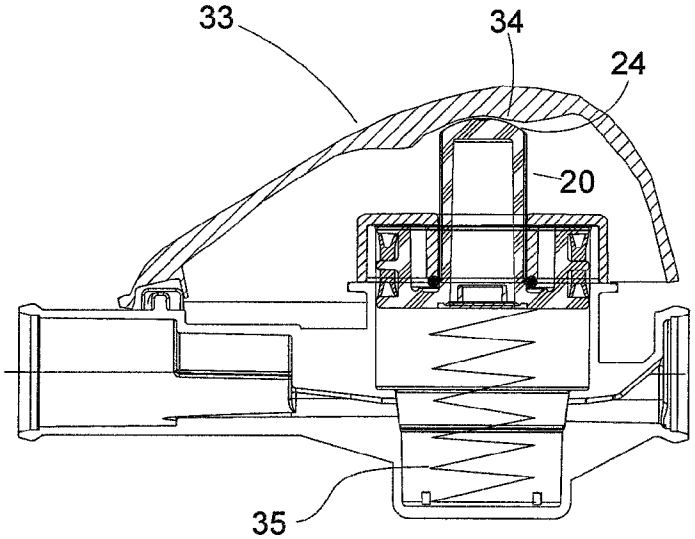

FIGS. 9A-9B illustrate how the fuel actuator 33 pivots through an arc as it is depressed (to prime). The curved surface 24 of the piston 20 allows the mating surface 34 of the actuator 33 to slide over the piston surface 24 during the stroke. This curved profile ensures consistent and constant contact between the piston 20 and the actuator 33 during the priming cycle. FIG. 9A shows the system in the up or ready position, and FIG. 9B shows the system in the down or pumped position. The piston 20 is biased by a spring 35.

Several descriptions and illustrations have been presented to aid in understanding features of the present invention. One with skill in the art will realize that numerous changes and variations are possible without departing from the spirit of the invention. Each of these changes and variations is within the scope of the present invention.

We claim:

1. A method of providing a primer for a marine engine with low hydrocarbon permeation comprising:

providing a pump housing molded from a rigid polymer material with a hydrocarbon permeation rating of less than around 15 g/sq·m·/day;

providing a pump mechanism fitting into said pump housing that includes a piston with a grooved stem and a disk-shaped base containing three independent seals, wherein fuel is drawn into said pump housing through an entrance orifice when said pump mechanism is relaxed and said piston is in an uppermost position, and a predetermined amount of fuel is dispensed through an exit orifice when said pump mechanism is exercised and said piston travels to a lower position;

combining said pump mechanism into said pump housing to produce a primer with a total hydrocarbon permeation of less than around 15 g/sq. meter/day.

2. The method of claim 1 wherein said pump mechanism contains a continuous molded flow path from an inlet hose to an exit hose.

3. The method of claim 1 wherein said pump mechanism includes an actuator above said pump piston, said piston having a curved top on its stem, said actuator having a curved recess in contact with the curved top of said piston, wherein said stem slides on said piston during a fuel priming stroke.

4. The method of claim 1 wherein said three independent seals contain an upward facing u-cupped seal, a downward facing u-cupped seal and an O-ring.

5. The method of claim 4 wherein said upward and downward facing seals are mounted on said disk-shaped base, said upward facing seal above said downward facing seal.

6. The method of claim 1 further comprising a bushing of minimum clearance that said stem slides through during a fuel stroke.

7. The method of claim 1 further comprising a floating valve seat that lifts back when back pressure exceeds from 5-8 psig.

8. A primer pump for a marine engine comprising:

a rigid housing containing pump body, a fuel flow path, a fuel inlet port into said fuel path and an exit port from said fuel flow path, said inlet and exit ports connectable at each end to fuel hoses;

a rigid actuator pivotly attached to said housing, said actuator pressing on a spring-biased rigid piston, said rigid piston entering said pump body when said rigid actuator is depressed causing fuel contained in said pump body to flow into said fuel path;

wherein said piston has a disk-shaped lower section and an elongated stem, said stem moving upward and downward through a bushing with minimum clearance, said stem also having a longitudinal groove to relieve air pressure, said disk-shaped lower section containing upper and lower u-cupped seals on said disk's periphery, and wherein said fuel flow path is made from material having a hydrocarbon permeation of less then around 15.0 g/sq. meter/day.

9. The primer pump of claim 8 wherein said lower u-cupped seal is cupped downward facing fuel, and said upper u-cupped seal is cupped upward facing air.

10. The primer pump of claim 8 wherein said u-cupped seals contain nitrile and acrylic, with a percentage of acrylic between 1% and 90%.

11. The primer pump of claim 8 wherein said stem includes a curved top, and wherein said curved top mates with a curved recess in an actuator such that said curved top slides in said curved recess during a fuel priming cycle.

12. A method of providing a primer for a marine engine with low hydrocarbon permeation comprising:

providing a marine engine primer with inlet and exit ports each connectable to fuel hoses;

providing a rigid housing containing pump body, a fuel flow path, and said inlet and exit ports;

mounting a rigid actuator pivotly attached to said housing, said actuator pressing on a spring-biased rigid piston, said rigid piston entering said pump body when said rigid actuator is depressed causing fuel contained in said pump body to flow into said fuel path, wherein said piston has a disk-shaped lower section and an elongated stem, said stem moving upward and downward through a bushing with minimum clearance, said stem also having a longitudinal groove to relieve air pressure, said disk-shaped lower section containing upper and lower u-cupped seals on the disk's periphery, and making said fuel flow path from material having a hydrocarbon permeation of less then around 15.0 g/sq. meter/day.

13. The method of claim 12 wherein said lower u-cupped seal is cupped downward facing fuel, and said upper u-cupped seal is cupped upward facing air.

14. The method of claim 12 wherein said u-cupped seals contain nitrile and acrylic, with a percentage of acrylic between 1% and 90%.

15. The method of claim 12 wherein said stem includes a curved top, and wherein said curved top mates with a curved recess in an actuator such that said curved top slides in said curved recess during a fuel priming cycle.

16. The method of claim 12 wherein said disk-shaped lower section of said piston also holds an O-ring.

17. The method of claim 12 further comprising providing a floating valve seat that lifts when back pressure exceeds approximately 5-8 psig.

* * * * *